US008682651B2

(12) United States Patent
Diggins

(10) Patent No.: US 8,682,651 B2
(45) Date of Patent: Mar. 25, 2014

(54) AUDIO VISUAL SIGNATURE, METHOD OF DERIVING A SIGNATURE, AND METHOD OF COMPARING AUDIO-VISUAL DATA

(75) Inventor: Jonathan Diggins, Chesham (GB)

(73) Assignee: Snell Limited, Berkshire (GB)

( * ) Notice: Subject to any disclaimer, the term of this patent is extended or adjusted under 35 U.S.C. 154(b) by 782 days.

(21) Appl. No.: 12/918,572

(22) PCT Filed: Feb. 20, 2009

(86) PCT No.: PCT/GB2009/050172
§ 371 (c)(1),
(2), (4) Date: Sep. 9, 2010

(87) PCT Pub. No.: WO2009/104022
PCT Pub. Date: Aug. 27, 2009

(65) Prior Publication Data

US 2011/0026763 A1 Feb. 3, 2011

(30) Foreign Application Priority Data

Feb. 21, 2008 (GB) ..... 0803178.3

(51) Int. Cl.
*G10L 11/00* (2006.01)

(52) U.S. Cl.
USPC ..... 704/200; 704/203; 704/206

(58) Field of Classification Search
USPC ..... 704/200–209, 272, 278
See application file for complete search history.

(56) References Cited

U.S. PATENT DOCUMENTS

| | | | | |
|---|---|---|---|---|
| 6,633,651 | B1 | 10/2003 | Hirzalla et al. | |
| 6,963,975 | B1 | 11/2005 | Weare | |
| 7,283,954 | B2 | 10/2007 | Crockett et al. | |
| 7,461,002 | B2 * | 12/2008 | Crockett et al. | 704/278 |
| 2003/0231712 | A1 | 12/2003 | Malayath et al. | |
| 2004/0054906 | A1 | 3/2004 | Carro | |
| 2006/0153296 | A1 | 7/2006 | Deng | |
| 2007/0092103 | A1 | 4/2007 | Mihcak et al. | |
| 2007/0247401 | A1 | 10/2007 | Sasagawa et al. | |
| 2007/0249081 | A1 | 10/2007 | Luo et al. | |
| 2009/0304082 | A1 * | 12/2009 | Radhakrishnan et al. | 375/240.15 |

FOREIGN PATENT DOCUMENTS

| | | |
|---|---|---|
| CN | 1524258 | 8/2004 |
| EP | 1482734 | 12/2004 |
| EP | 1519363 | 3/2005 |
| EP | 1855142 | 11/2007 |
| EP | 1975938 | 10/2008 |
| GB | 2428924 | 2/2007 |
| GB | 24301012 | 3/2007 |

(Continued)

OTHER PUBLICATIONS

International Search Report for PCT/US2009/050172, dated Oct. 16, 2009 (3 pages).
International Search Report for PCT/GB2009/050172, dated Aug. 12, 2009 (6 pages).
Written Opinion for PCT/GB2009/050172, dated Aug. 12, 2009 (8 pages).

(Continued)

*Primary Examiner* — Huyen X. Vo
(74) *Attorney, Agent, or Firm* — Michael Best & Friedrich LLP

(57) ABSTRACT

The invention relates to the analysis of characteristics of audio and/or video signals for the generation of audio-visual content signatures. To determine an audio signature a region of interest for example of high entropy—is identified in audio signature data. This region of interest is then provided as an audio signature with offset information. A video signature is also provided.

4 Claims, 6 Drawing Sheets

(56) References Cited

FOREIGN PATENT DOCUMENTS

| | | |
|---|---|---|
| GB | 2434496 | 7/2007 |
| GB | 2437337 | 10/2007 |
| GB | 2437338 | 10/2007 |
| GB | 2458934 | 10/2009 |
| KR | 20040103351 | 12/2004 |
| WO | 0128240 | 4/2001 |
| WO | 0209328 | 1/2002 |
| WO | 02097791 | 12/2002 |
| WO | 02097792 | 12/2002 |
| WO | 2004002131 | 12/2003 |
| WO | 2004002159 | 12/2003 |
| WO | 2004002160 | 12/2003 |
| WO | 2007014325 | 2/2007 |
| WO | 2008143768 | 11/2008 |
| WO | 2009/026564 | 2/2009 |

OTHER PUBLICATIONS

Search Report from the United Kingdom Intellectual Property Office for Application No. 1205756.8 dated May 16, 2012 (6 pages).

Search Report from the European Patent Office for Application No. 12156702.8 dated Jul. 6, 2012 (10 pages).

First Office Action from the State Intellectual Property Office of the People's Republic of China Application No. 200980112996.2, dated Nov. 16, 2011 (Translation—13 pages).

Intellectual Property Office of Great Britain Search Report Application No. 0803178.3, dated Jan. 26, 2009, 3 pages.

Intellectual Property Office of Great Britain Search Report Application No. 0803178.3, dated Jan. 22, 2009, 2 pages.

Intellectual Property Office of Great Britain Search Report Application No. 0803178.3, dated Jun. 9, 2008, 3 pages.

* cited by examiner

AUDIO VISUAL SIGNATURE, METHOD OF DERIVING A SIGNATURE, AND METHOD OF COMPARING AUDIO-VISUAL DATA

CROSS-REFERENCE TO RELATED APPLICATIONS

This patent application is a national stage filing under 35 U.S.C. 371 of International Application No. PCT/GB2009/050172, filed Feb. 20, 2009, which claims foreign priority to Great Britain Patent Application No. 0803178.3, filed Feb. 21, 2008, the disclosures of which are incorporated by reference herein in their entireties. Priority to each application is hereby claimed.

FIELD OF THE INVENTION

The invention relates to the analysis of characteristics of audio and/or video signals. In particular, the invention relates to the generation and use of audio-visual content signatures.

BACKGROUND OF THE INVENTION

Increasingly broadcasters are interested in generating fingerprints, or signatures, of audio, video or audio-visual content, and in comparing fingerprints or signatures of such content in one or more audio, video or audio-visual data files and/or at one or more positions in a transmission chain, or in parallel transmission chains for audio and video content.

Many different methods of obtaining fingerprints, or signatures, are known. The present invention seeks to provide a new signature and techniques for obtaining and using signatures that extend the suite of techniques available in the prior art. The signature of the present invention may be particularly suitable for applications in which a small signature size is required.

SUMMARY OF THE INVENTION

According to one aspect of the invention there is provided a method of deriving a signature characteristic of a plurality of audio samples comprising the steps of: determining audio signature data representative of the audio samples; determining a section of the audio signature data forming a region of interest; and providing the audio signature data section and position data identifying the position of the region of interest within the audio signature data as an audio signature.

According to a second aspect of the invention there is provided a method of deriving a signature characteristic of a plurality of fields or frames of video data and associated audio samples comprising the steps of: determining an audio signature in accordance with the invention; determining spatial profile data of the video fields or frames dependent on picture information values in the video fields or frames; forming a video signature from the spatial profile data; and, providing the audio signature and the video signature as an audio-visual signature.

According to a third aspect of the invention there is disclosed a method of deriving a signature characteristic of a plurality of fields or frames of video data comprising: determining spatial profile data of the video fields or frames dependent on the picture information values in the video fields or frames; and forming a signature from the spatial profile data.

According to a fourth aspect of the invention there is provided a method of comparing video or audio-visual data in which a plurality of comparisons are made between first video signature data derived from one or more fields or frames of a first video or audio-visual sequence and second video signature data derived at plurality of temporal positions within a second video or audio-visual sequence and the temporal position of best match of video signature data is established.

According to a fifth aspect of the invention there is provided a method of comparing audio or audio-visual data in which a plurality of comparisons are made between first audio signature data derived from two or more audio samples of a first audio or audio-visual sequence and second audio signature data derived at plurality of temporal positions within a second audio or audio-visual sequence and the temporal position of best match of audio signature data is established.

According to a sixth aspect of the invention there is provided a computer program product comprising code adapted to implement a method in accordance with the invention.

According to a seventh aspect of the invention there is provided an apparatus adapted to implement a method in accordance with the invention.

According to a eighth aspect of the invention there is provided a signature for audio-visual data comprising a video signature; and an audio signature comprising audio signature data and offset data identifying the position of a region of interest.

BRIEF DESCRIPTION OF THE DRAWINGS

Examples of the invention will now be described with reference to the accompanying drawings, in which.

DETAILED DESCRIPTION OF THE INVENTION

The invention will now be described with reference to the accompanying drawings. The invention may be applied to the analysis of streaming audio-visual data and may also be applied to the analysis of audio-visual data files or other representations of audio-visual sequences. Signature data resulting from the analysis of streaming audio-visual data and/or audio-visual data files can be compared to establish identity of the audio-visual content and to measure delay between the audio data and the nominal capture time (for example a time-code) and/or between the video data and the nominal capture time (for example a time-code) and/or to measure the relative delay between the audio data and the video data.

A first embodiment of the present invention will be described with reference to an audio-visual content comparison between streaming audio-visual information at two points in a broadcast chain.

Figure 1:
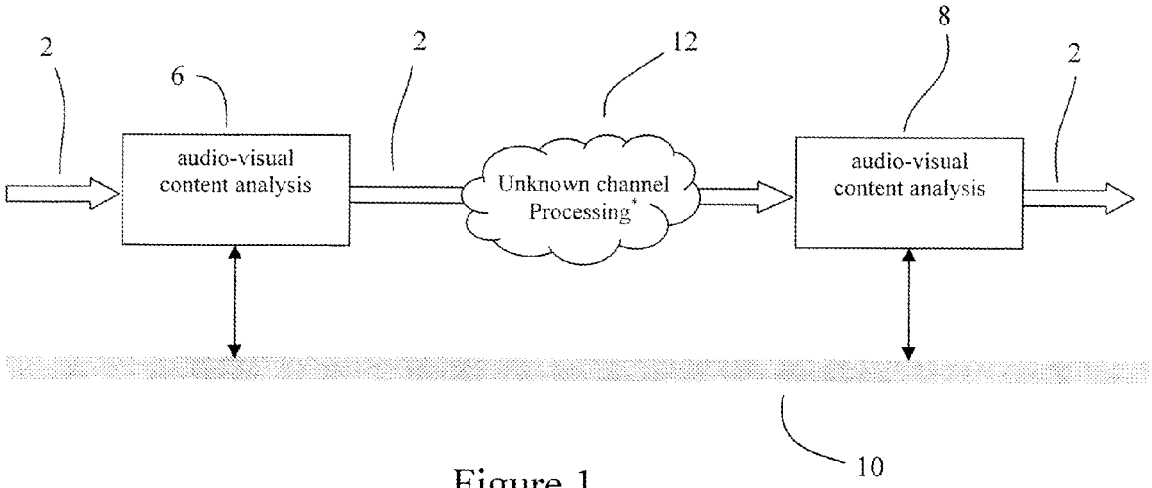
FIG. 1 shows an overview of a monitoring system in which the invention can be implemented.

FIG. 1 shows an overview of a monitoring system in which the invention can be implemented. A communication channel 2 carrying audio-visual (AV) data representing particular AV content has a first AV content analyser 6 and a second AV content analyser 8 inserted therein. These analysers may generate metadata and append it to the data carried on the communication channel 2. The first AV content analyser 6 is coupled with the second AV content analyser 8 via an auxiliary communication channel 10, enabling instructions and data to be exchanged between the first AV content analyser 6 and the second AV content analyser 8. This auxiliary channel 10 may be a control and monitoring channel and may be implemented in any known manner. Typically the auxiliary channel 10 will be of low bandwidth compared with the bandwidth of the channel 2.

Unknown channel processing 12 exists in the channel 2 between the first AV content analyser 6 and the second AV content analyser 8. The unknown channel processing 12 is exemplified by but not limited to: audio or video noise reduction; audio or video compression; video logo insertion; video colour gamut legalisation; audio or video synchronisation; audio into/out of video embedding/de-embedding, video standards conversion; and, audio or video format or compression transcoding. This processing may alter the AV data and/or alter the delay between the audio data and the video data at different points. As a result it is desirable to compare the AV data at the first AV content analyser 6 with the AV data at the second AV content analyser 8 to verify whether the AV content is the same at the first AV content analyser 6 as at the second AV content analyser 8. In addition it may be useful to compare the relative delay between the audio and video data at the each of the analysis points.

Clearly, as will be apparent to a skilled person, the present invention can be applied to other system arrangements. For example, the present invention may be used to compare the audio-visual content and to measure relative delay between multiple audio-visual feeds portraying the same content from a production process, and in many other contexts.

The outline operation of the illustrative system will now be described. In the following description it is assumed that the second AV content analyser 8 is a "master" AV content analyser that instructs the first AV content analyser 6 to generate an AV signature and compares its own AV signature with the AV signature generated by the first AV content analyser 6. However, as will be apparent to a skilled person, alternatively the system can be arranged such that the first AV content analyser 6 acts as the master content analyser; or, such that a separate device acts to instruct the first and second AV content analysers 6, 8 to generate and report respective AV signatures.

In a first step, a time at which the AV analysis should be performed is selected. In the illustrative embodiment the second AV content analyser 8, acting as a master content analyser, selects the time at which the AV analysis should be performed and instructs the first AV content analyser 6 to generate an AV signature at the selected time. The second AV content analyser 8 also generates an AV signature at the selected time.

The time should be selected so that the time is still in the future when the instruction to generate the AV signature at that time is received by the first AV content analyser 6, taking into account any delays in the auxiliary channel 10 between the second AV content analyser 8 acting as a master content analyser and the first AV content analyser 6. The selected time generally will relate to a feature of the AV content itself. Thus, in one arrangement the selection of the time at which the AV analysis is to be performed can be achieved by specifying a particular time-code, distributed with or embedded in the AV data, at which the AV signature is to be generated. Other methods of determining when AV analysis is to be carried out are possible, for example AV analysis may be carried out at regular time-code intervals and/or after a determined number of fields, frames or sample clocks, or when a program change or other program feature is detected.

In a second step, an AV signature for the AV content is generated at the specified time. In the illustrative embodiment, the first and second AV content analysers 6, 8 both generate AV signature data for the AV content. Typically, each of the first and second AV content analysers 6, 8 firstly capture a pre-arranged duration of AV content and store the captured AV content in local memory.

Clearly the capture of the AV content at the first and second AV content analysers 6, 8 will not occur synchronously in real-time if, as would typically be the case, there is any delay in the channel 2 between the first and second AV content analysers 6, 8 and in the auxiliary channel 10. However the AV content captured will be nominally the same AV content because the capture of the AV content is initiated by the detection of a feature of the AV content itself, for example the time-code in the illustrative embodiment.

In each of the AV content analysers 6, 8, the captured AV content can be processed to generate an AV signature, as will be explained in more detail hereafter. Corresponding processing is carried out in each of the AV content analysers 6, 8 and the processing may relate to audio information only, or may relate to video information only, or may relate to both audio and video information. In the present description both audio and video information are captured and processed to generate an AV signature, as will be explained in more detail in the following description. However, in some embodiments it would be possible to capture and process only audio information, or only video information, to generate the AV signature.

In a third step, a comparison is made between the AV signatures. The first AV content analyser 6 sends its AV signature to the second AV content analyser 8, which in this embodiment is acting as the master content analyser. The AV signature data can be compared, for example in a software correlation measurement, to determine whether the AV signatures are the same. In addition, a confidence level in the result can be established. The comparison of the AV signature data will be explained in more detail in the following description.

It will be appreciated by a skilled person that an audio signature may be generated in a variety of ways. A detailed method of establishing an audio signature to form the whole, or part, of the AV signature in accordance with exemplary embodiments of the invention will now be described.

The audio signature of the exemplary embodiment is a characteristic binary signal that represents the audio content. If the signature is represented visually, for example using a black stripe to represent a "0" in the audio signature and a white stripe to represent a "1", or vice versa, a characteristic pattern of black and white stripes will occur. This characteristic stripe pattern is visually reminiscent of a retail bar-code, and as a result the audio signature may be referred to as an audio bar-code. Generally the audio signature will be representative of the original signal, at least in the sense that different audio signals will generate different audio signatures, and the audio signature can be represented by significantly fewer bits than the original audio signal.

In some embodiments the audio signature may be generated directly from the original audio samples, or in other embodiments the original audio samples may be processed in some way before the audio signature is generated. In the illustrated embodiment the input audio samples undergo an exemplary processing to reduce the size of the resulting audio signature, as will be explained in more detail hereafter.

For streaming or uncompressed audio-visual data, a sampling rate of 48 kHz is typically used for each audio channel. As a result, each field or frame of video data, occurring at a frequency of 50-60 fields or frames per second, will contain 800-960 audio samples for each audio channel. Typically AV content will have a plurality of audio channels associated with the video data; some current systems provide 16 channels of audio data accompanying the video data.

A useful audio signature can be generated without the use of the full audio sampling rate since much of the useful discriminatory information is contained in the low frequencies. In the exemplary embodiment the captured audio samples for each channel are passed through a low-pass filter, and the output of the low-pass filter is then decimated. This processing retains useful discriminatory information contained in the low frequency components of the original signal, while minimising or eliminating aliasing from the higher frequency components of the original signal that would otherwise result from the decimation (i.e. the reduction in the sampling frequency).

A binary signal may be generated from the output of a low-pass filter. In an exemplary embodiment low-pass filtered audio samples are high-pass filtered to remove the DC component and the very lowest frequency components; the resulting filtered audio samples are decimated. The series of sign bits of the decimated, filtered audio samples forms the audio signature data.

Figure 2:
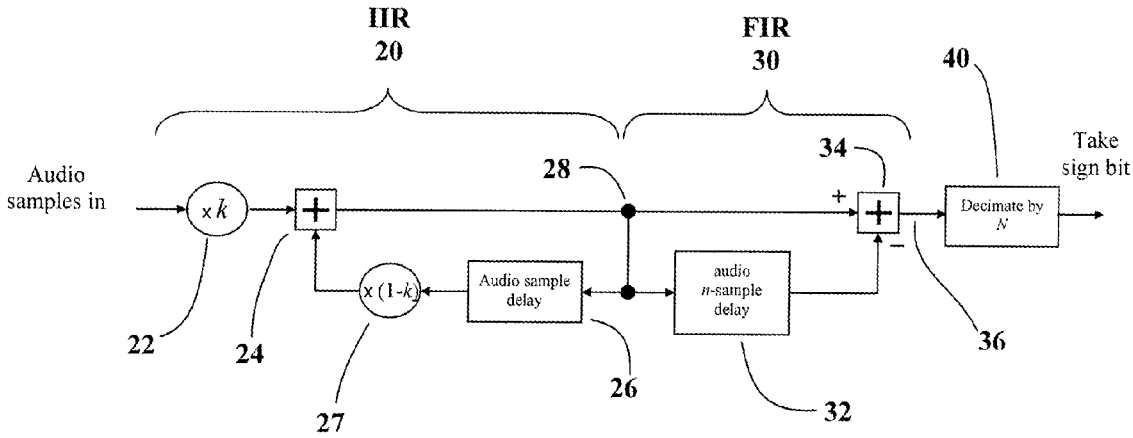
FIG. 2 is a block diagram of a circuit for generating audio signature data in accordance with a first exemplary embodiment.

FIG. 2 is a block diagram of a circuit for generating audio signature data in accordance with an exemplary embodiment; and its operation will now be described. Audio samples, which have for example been de-embedded from the blanking intervals of one or more video fields or frames, are low-pass filtered in an infinite impulse response (IIR) filter stage 20 and the result is high-pass filtered in a finite impulse response (FIR) filter stage 30 having zero response at DC. The output of the FIR filter stage 30 is applied to a decimator 40, and the sign bits of the output of the decimator 40 are taken and stored in memory to form exemplary audio signature data.

The IIR low-pass filter stage 20 includes a multiplier 22 for multiplying the input samples by a factor k. The output of the multiplier 22 is passed to one input of a two-input adder 24. The output of the adder 24 is passed through a one-sample-period delay 26, and multiplied, in a multiplier 27, by a factor (1−k), before being applied to the other input of adder 24. The output of adder 24 forms the output 28 of the IIR filter stage 20, which is then applied to the FIR filter stage 30.

The FIR high-pass filter stage 30 includes an n-sample delay 32 and a subtractor 34, to both of which the IIR filter output 28 is applied. The output of the n-sample delay 32 is supplied to the other input of the subtractor 34. The subtractor 34 subtracts the delayed IIR filter output (from the n-sample delay 32) from the undelayed IIR filter output 28, and outputs the result as the FIR filter stage output 36.

As indicated above, the FIR filter stage output 36 is applied to the decimator 40. The decimator 40 decimates the filtered audio samples by a factor N, and the sign bits of the resulting decimated series of filtered audio samples are successively stored to form audio signature data. For an audio sample rate of 48 kHz a suitable value for N is 160. For 16-bit audio samples the decimation process, together with the step of taking only the sign bit of the filtered output samples, thus results in a 2,560:1 reduction in data size from the initial audio data samples to the audio signature data.

Clearly, although in the exemplary embodiment the audio samples are sampled at a sampling rate of 48 kHz, the invention may be applied to audio samples at any sampling rate. In some embodiments the audio data may be rectified prior to the filtering process so that data values corresponding to the absolute magnitude of the audio samples are processed; the rectified and filtered data then represents a measure of the energy of the portion of the audio spectrum falling within the filter pass-band. In the illustrative embodiment values of k=1/512 and n=160 result in a filter that isolates a low frequency band extending from approximately 10 Hz to approximately 300 Hz. However, a person skilled in the art will be able to design other filter arrangements and select different parameters.

Figure 3:
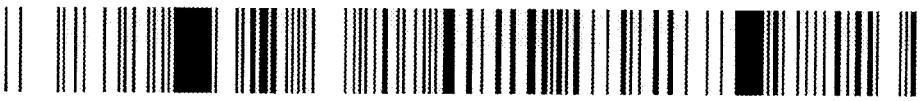
FIG. 3 shows an exemplary audio signature.

FIG. 3 shows exemplary audio signature data representing just over one second of audio and is 320 bits wide. In this example each digit of the audio signature data is represented visually by using a black stripe to represent a "0" in the audio signature and a white stripe to represent a "1", leading to the characteristic pattern of black and white stripes or bars. A pattern of alternating black and white bars of variable widths results from this visual representation of the audio signature data, as can be clearly seen in the exemplary visual representation of the audio signature data of FIG. 3, A region of interest section of the audio signature may be selected, which will achieve a further reduction of the size of the audio signature data. In the exemplary embodiment, the generated audio signature data is evaluated to determine the section of the audio signature data which will be the most distinctive and therefore useful for identification purposes. Typically this will be the section of the audio signature data with the maximum local variation in the distribution of bar widths.

This selected section of audio signature data, and position data identifying the position of the selected section of audio signature data within the original audio signature data, is used as the audio signature. In the present embodiment a section of 120 bits out of 450 bits, generated from 72,000 audio samples as described above, is selected. Clearly, however, other values for the length of the selected section and the total length of the audio signature data can be used.

The section of audio signature data with the maximum variation in bar widths can be selected in a number of ways, one method is to measure the entropy of the distribution of bar widths within a plurality of sections of the audio signature data, and to select the section that has the highest measured entropy associated therewith. In the exemplary embodiment this can be achieved by successively selecting sections of the audio signature data, for example a number of short sections at different temporal offsets relative to the selected time at which the audio analysis is requested to be carried out. For each offset position, a histogram of the relative frequencies of occurrence of the different bar widths is created; the widths being measured as the number of adjacent 1s, or adjacent 0s, comprising each 'bar'. The entropy of each section can be obtained from the respective histogram of width values, and the section with the highest entropy can be selected.

Figure 4:
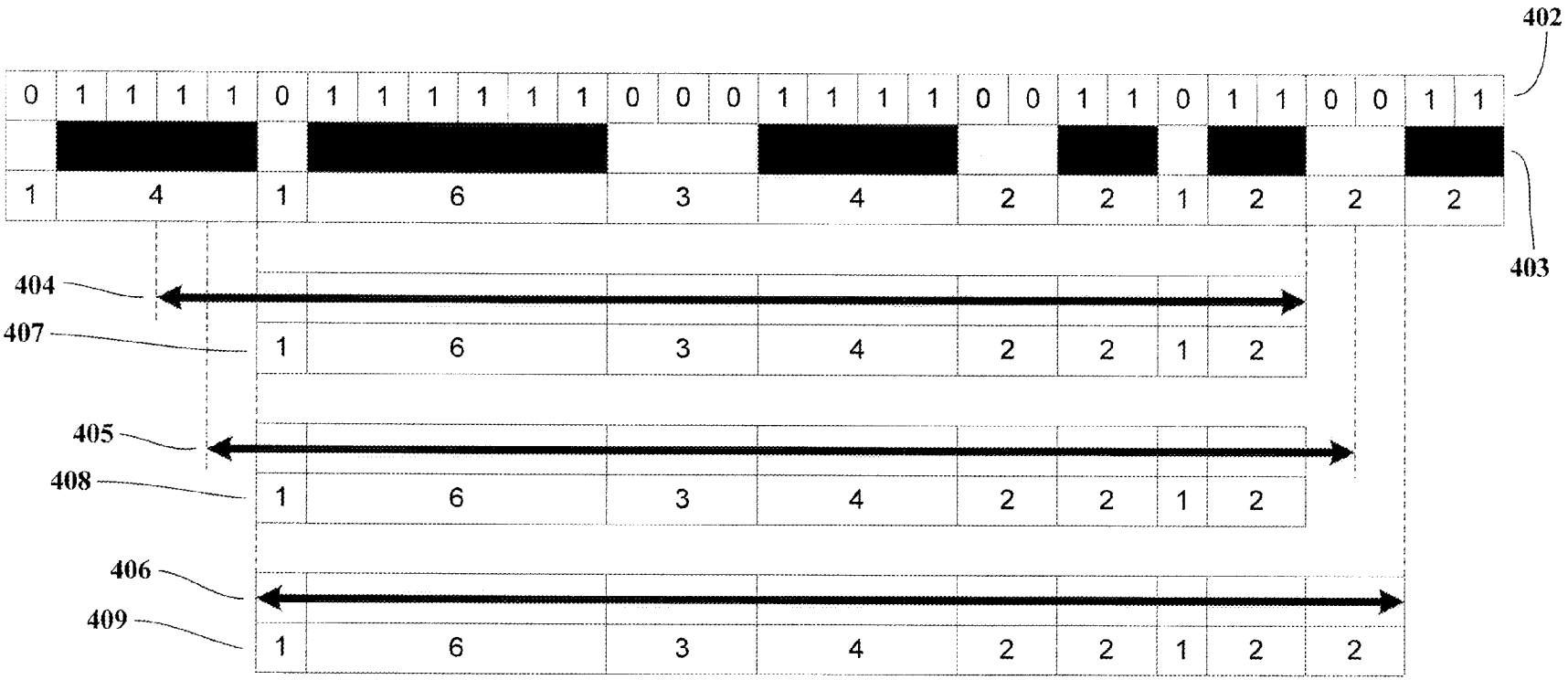
FIG. 4 illustrates the selection of a representative segment from an exemplary audio signature.

An example of such a process is shown in FIGS. 4 and 5. FIG. 4 shows a short portion of audio signature data 402, and the corresponding 'bar' representation 403. Three 22-bit wide windows within the signature data are also shown 404 405 406. Windows 405 and 406 are offset from window 404 by one and two bits respectively. The widths of the bars wholly included within each respective window are shown at 407 408 and 409.

It can be seen that windows 407 and 408 include the same group of bars, but window 409 includes an additional bar.

Figure 5A:
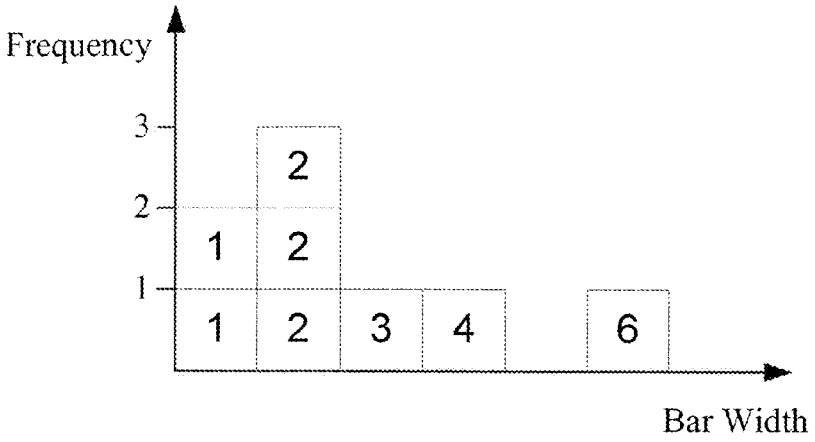
FIG. 5 shows exemplary histograms of transition distance counts within selected segments of audio signature data.
Figure 5B:
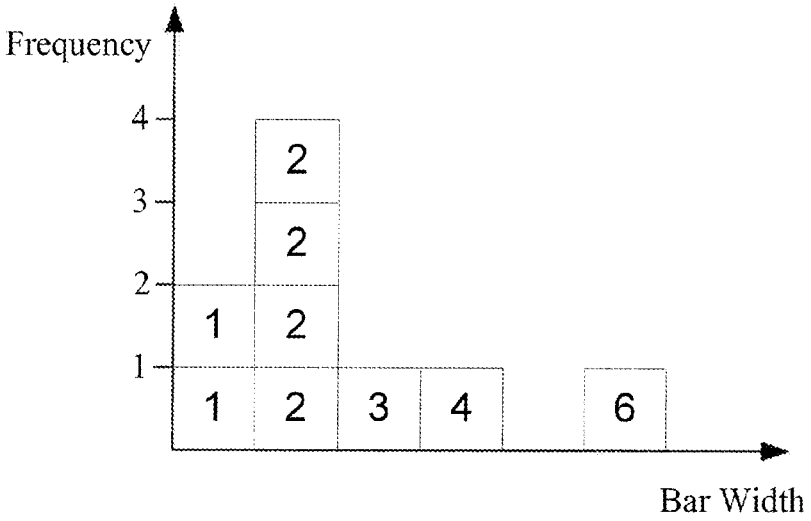

FIG. 5 shows histograms of the frequency of occurrence of bar lengths for the windows; FIG. 5*a* corresponds to windows 404 and 405, and FIG. 5*b* corresponds to window 406.

The entropy corresponding to each of these histograms can be calculated according to the following equation:

$$E_w=\Sigma=p_i \log(p_i)$$

Where:

$E_w$ is the entropy for the relevant window;

$p_i$ is the frequency of occurrence of bar-width i divided by the total number of bars within the window (this total will be denoted in later equations by $N_w$); and, the summation is made over all values of i that occur in the relevant window.

As the objective is to seek a maximum entropy value, the base of the logarithm is not relevant, although, usually, the base two is used when calculating amounts of information.

In the illustrated example, FIG. 5*a* has marginally higher entropy, because the distribution is less 'peaky'.

In a practical application, in order to achieve an efficient process, it is desirable to simplify the repeated entropy calculations; this can be achieved by finding the entropy of an initial window and then evaluating the change in entropy as the position of the window is incremented. Once the entropy of a first window has been evaluated, the difference in entropy of an offset, overlapping window can be found by re-evaluating only those contributions to the summation which change as a result of bars entering or leaving the window, and incrementing or decrementing the first entropy value as appropriate.

If the window position is shifted by one bit-period, the total number of bars within the window $N_w$ will either:

increase by unity; or, remain unchanged; or, decrease by unity.

And, either:

No frequency values will have changed; or, one frequency value will have increased by unity;

one frequency value will have decreased by unity; or, one frequency value will have increased by unity, and another frequency value will have decreased by unity.

If bar(s) of width $n_+$ have become more numerous, and/or bar(s) of width $n_-$ have become less numerous, then the change in entropy value due to the shift of the window can be expressed mathematically as follows:

If $E_w$ is the entropy of the original window, encompassing $N_w$ bars; and, $E_{w+1}$ is the entropy of the shifted window, encompassing $N_{w+1}$ bars:

Let $$f(w)=\{N_w \log(N_w)\}E_w$$

and $$f(w+1)=\{N_{w+1} \log(N_{w+1})\}E_{w+1}$$

It can then be shown that:

$$f(w+1)=f(w)-N_w \log(N_w)+N_{w+1} \log(N_{w+1})+\Delta_++\Delta_-$$

Where:

$$\Delta_+=\{n_+ \log(n_+)-(n_++1)\log(n_++1)\}$$

or zero, if no frequency value increases;

and, $$\Delta_-=\{n_- \log(n_-)-(n_--1)\log(n_-+1)\}$$

or zero, if no frequency value decreases.

As the window position is incremented it is relatively straightforward to calculate $\Delta_+$ and $\Delta_-$ and therefore to find the change in f(w), from which the window position of maximum entropy can be determined.

Typically a 120-bit-wide window having maximum entropy is selected from within a 450-bit-wide segment of audio signature data. Once the section of the audio signature data with greatest entropy, and the position of that section within the audio signature data, has been established, the data comprising the section and the data describing its position can be used as the audio signature.

Preferably the selection of the audio signature data section is biased to select a section near the middle of the captured audio signature data so as to provide maximum capability to detect delay, and so as to accommodate both positive and negative delays. This may be achieved simply by not including the edge regions of the audio signature data in the determination of the maximum entropy section. Alternatively the calculated entropy could be adjusted by a variable amount in order to bias the choice of the maximum entropy section towards the middle of the captured audio signature data.

Where the AV data includes multi-channel audio data, an audio signature as described above may be generated in respect of one or more of the audio channels.

A special case of multi-channel audio is 'surround-sound' where, typically, six or more audio signals are presented to the listener simultaneously from differently located loudspeakers. There are known techniques for 'down-mixing' such a group of audio signals into a smaller number of channels—usually a 'stereo pair' comprising two signals intended for 'left' and 'right' loudspeakers respectively. There are also related systems in which the reduction in the number of channels involves non-linear processing, or frequency dependant phase shifting, in order to enable recovery of the higher number of channels from the lower number with minimal subjective impairment.

Audio signatures of surround-sound material can be derived from two channels down-mixed from a higher number of channels by to either of the above methods. This often enables a significant simplification of the monitoring system. In some situations a useful signature can be derived from a single channel down-mixed from a multi-channel surround sound source.

When sufficient data capacity is available, the audio signature may be augmented by the inclusion of 'metadata' obtained by other audio analysis tools. The above-described signature derived from band-limited audio may not adequately represent events outside the bandwidth of the filters used; in particular high-frequency transients, such as 'clicks' caused by interference or equipment malfunction may be overlooked. Known techniques to detect such events, possibly including the detection of consecutive audio samples having the same value, can be used and the number of detected events in a defined time period can be formatted as meta-data and included in the signature.

Other suitable meta-data includes amplitude or subjective loudness information, including detection of periods of silence.

It will be appreciated by a skilled person that a video signature may be generated in a variety of ways. A detailed method of establishing a video signature to form the whole or part of the AV signature in accordance with exemplary embodiments of the invention will now be described.

The term "spatial profile data" will be used to refer to information relating to the spatial distribution of picture information, for example luminance values of pixels, within each field or frame of video data. Spatial profile data can be highly effective in discriminating between sections of video. However a relatively large amount of information relating to the spatial distribution of picture information is required for accurate discrimination between sections of video. In situations where reduction in the size of the signature is advantageous, spatial profile data may be provided for only some of the video fields or frames and/or may be combined with other types of signature information.

The term "motion profile data" will be used to refer to motion-based signature information relating to differences in picture information between consecutive fields or frames of video data. Motion-based signature information is highly effective in discriminating between sections of video and produces a highly distinctive video signature. In particular motion-based signature information has been found to be very effective in characterising video sequences and is tolerant of, for example logo insertion or compression coding. However, for static or low motion images or fades to black, compression artefacts can be significant and it is difficult to discriminate between these types of images using motion-based signature information alone.

In order to provide a robust video signature, therefore, in the exemplary illustrative embodiment both motion-based signature information and spatial-based signature information are used in the video signature.

It will be appreciated by a skilled person that both motion-based signature information and spatial-based signature information may be generated in a variety of ways.

In the exemplary embodiment, the motion-based signature information is determined by firstly block-accumulating input pixel luminance values in regions of the input image. Each of the regions of the input image will be denoted herein as a Picture Region (PR) and has a corresponding PR block value.

This process can be considered to be a combined low-pass filtering and sub-sampling operation. The sub-sampling operation reduces the amount of memory and the number of processing operations needed to generate the motion-based signature information and is of particular interest where memory or processing resource is scarce.

The sub-sampling operation used in the exemplary embodiment results in a representation of a field or frame that is detailed enough to enable inter-frame or inter-field differences to be picked out reliably. In the exemplary embodiment the PR size is selected so as to divide the field or frame into the same number of PRs both horizontally and vertically irrespective of the number of pixels in the input fields or frames. By ensuring that there are the same numbers of PRs in different picture sizes, comparison between fields or frames with different raster structures, e.g. between interlaced and progressive scanned fields or frames is made possible. This enables accurate comparison for example between High Definition (HD) and standard definition (SD) pictures. Thus, for example a PR size of 24 pixels horizontally and 24 lines vertically may be used for a field of 1080-line interlaced high definition (HD) video; a PR size of 16 pixels horizontally and 32 lines vertically may be used for a frame of 720-line progressive high definition (HD) video; and a PR size of 9 pixels horizontally and 12 lines vertically may be used for a field of 576-line interlaced standard definition (SD) video.

In order to generate motion-based signature information, the block value for each PR is compared with the block value of the corresponding PR in the previous field or frame, and the difference values for each PR of a particular field or frame are accumulated over all the PRs of that field or frame. The accumulated difference value for the whole field or frame is truncated to an 8-bit value, thus effectively determining the average pixel difference value between a pair of adjacent fields or frames.

Thus the motion-based signature information in the exemplary embodiment comprises a byte per field or frame.

In the exemplary embodiment spatial-based signature information is also derived from the block values of the PRs which were generated during the determination of the motion-based signature information. In order to avoid any erroneous results caused by logos or other additional content, in the exemplary embodiment a spatial signature detection window is defined that excludes the periphery of the picture from the spatial signature. This is shown in FIG. 6, where a centrally placed spatial signature window 62, having a width equal to 0.8 times the picture width and a height equal to 0.5 times the picture height, is used.

The picture width and height used to derive the window (which is also applied when deriving motion-based signature data) are determined after excluding any 'black bars' that have been added in order to match the intended aspect ratio of the picture to the aspect ratio of the display device specified in the relevant transmission standard. (These 'bars' may not always be black, but will be uniform in appearance.) Thus for a 16:9 aspect ratio picture 'letterboxed' for display in the centre of a 4:3 aspect ratio display, the height of the window will be reduced from ½ the transmitted picture height to ⅜ of the picture height. And, for a 4:3 picture 'pillar boxed' for display in the centre of a 16:9 display device, the width of the window will be reduced from 8/10 of the transmitted picture width to ⅗ of the picture width.

The presence and size of any black bars may be detected automatically, for example by the method described in UK Patent Application 0806050.1 Alternatively the presence of bars can be derived from data associated with the audiovisual material being analysed.

Figure 6:
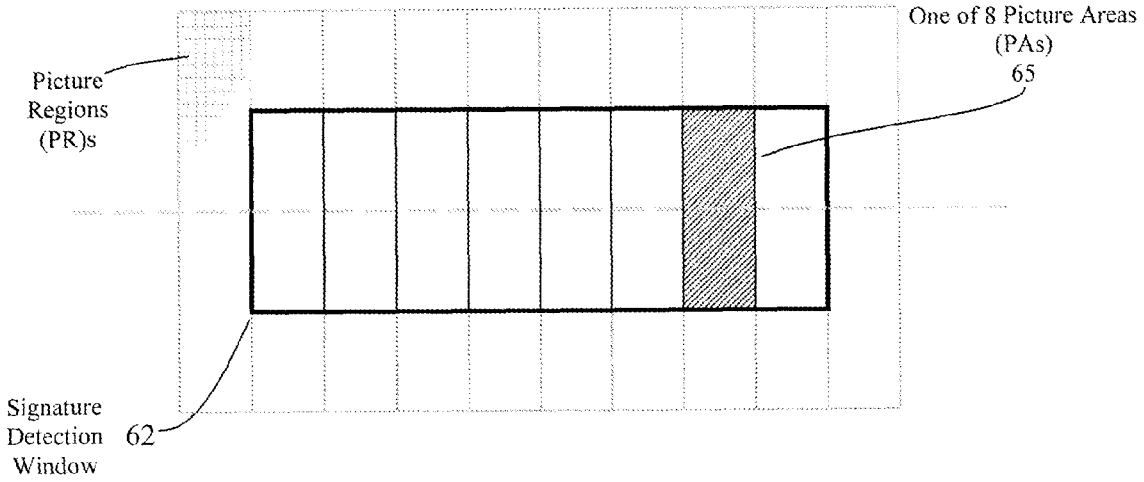
FIG. 6 shows an exemplary video spatial signature detection window.

Eight spatial picture areas (PA) are defined by dividing the spatial signature window into 8 columns, such as the PA 65, as is shown in FIG. 6. Spatial-based signature information is derived for each of the eight PAs by accumulating the PR block values of the PRs falling within the respective PA to form a respective PA block value.

The accumulated block PA value for one of the eight PAs can be up to 24 bits, assuming 8 bit video data. In the exemplary embodiment, each of the eight PA block values is truncated to 8 bits; thus giving a quantised representation of the average luminance in each PA. In the exemplary embodiment these eight bytes are used as spatial-based signature data for each field or frame.

In some embodiments spatial profile data for every field or frame of the captured AV content is included in the video signature; i.e. a continuous spatial signature is provided. In other embodiments spatial profile data for only some of the fields or frames of the captured AV content is included in the video signature; i.e. a discontinuous spatial signature is provided. The inclusion of spatial profile data for only some of the fields or frames of the captured AV content does not significantly impair the accuracy of analysis of the video signal, but does reduce the size of the video signature considerably. This reduction in the size of the video signature may be advantageous in situations where it is desirable to reduce the channel capacity required to transfer the signature, or the storage capacity required to store the signature.

A typical example of a video signature associated with a specified time point in an interlaced video or audio-visual sequence thus comprises motion-based signature data and spatial-based signature data derived from selected fields in a short portion (90 fields, say) of the sequence up to and including the specified time point.

The motion-based part of the signature comprises the sequence of 50 motion-based signature data bytes derived from a 50 field portion of the video sequence taken from the centre of the 90 field portion up to and including the specified time. And, the spatial-based part of the signature comprises eight bytes of data taken from each of four fields within the 50 field portion, together with two bytes describing the positions of these four fields within the 50 field portion. The video signature associated with the specified time point thus comprises a total of 86 bytes.

As described above for the case of audio signatures, a video signature can be augmented by the addition of meta-data from video analysis tools. Suitable data includes:

- Measures of artefacts due to block-based processing, for example as obtained by the methods described in UK patent application GB 2 437 337
- Measures of 'blackness' as obtained by the methods described in UK patent application GB 2 434 496
- Measures of the lack of colour as obtained by the methods described in UK patent application GB 2 437 338
- Measures of 'stillness' as obtained by the methods described in UK patent application GB 2 428 924
- Measures of the 'non-picture' (e.g. uncorrelated information due to equipment malfunction) nature the video as obtained by the methods described in UK patent application GB 2 430 102

Figure 7:
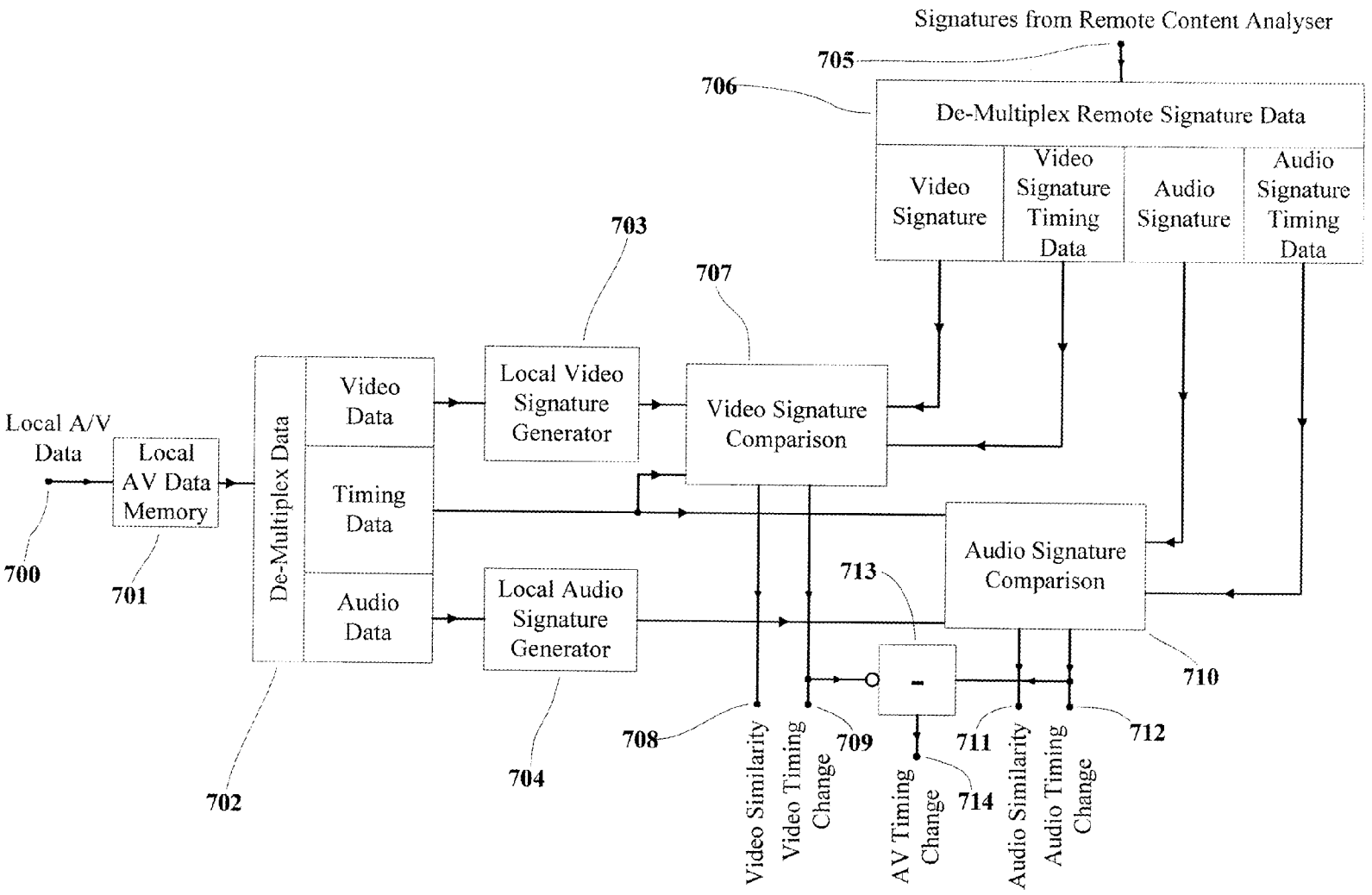
FIG. 7 illustrates the operation of a master AV content analyser in the exemplary embodiment.

The comparison of AV signatures will now be explained in more detail in the following description of FIG. 7, which illustrates the operation of the second AV content analyser 8 of FIG. 1 acting as a master AV content analyser in the exemplary embodiment.

Local AV data 700 (from the channel 2 of FIG. 1) is input to a local AV data memory 701, which is arranged to hold the currently-received data and a short preceding data portion. Typically, data corresponding to around 1.5 seconds of audio-visual material is held in the store; data older than this is discarded as newer data becomes available and is input to the memory 701.

The AV data 700 will typically include audio, video and associated timing information (e.g. time-code values, timing reference signals, synchronising pulses or time stamps etc.). The contents of the memory 701 are separated into these three components by a de-multiplexer 702. For the exemplary 1.5 second store, the video data from the de-multiplexer 702 could comprise 75 fields of 50 field per second video, or 90 fields of 60 field per second video; and, the audio data from the de-multiplexer 702 could comprise 72,000 audio samples.

The timing data from the de-multiplexer 702 enables the timing of these demultiplexed video fields and audio samples to be determined in terms of the timing data associated with the input AV data 700. As explained earlier, features of the AV content itself may be used to define time positions.

The de-multiplexed video data is converted into local video signature data by a local video signature generator 703, which provides video signature data for all the fields or frames stored in the memory 701. Typically the local video signature generator 703 will operate as described above and will generate one byte of motion-based signature data, and eight bytes of spatial signature data per field or frame.

The de-multiplexed audio data is converted into local audio signature data by a local audio signature data generator 704. Typically the local audio signature generator 704 will operate as described above to filter the audio samples, decimate the result and take the sign bits. This will generate 450 bits of signature data from the 72,000 audio samples. (Note that no selection according to entropy is made in this process.)

In addition, AV signatures 705 from the first AV content analyser 6 of FIG. 1 are received via a connection to the auxiliary communication channel 10 of FIG. 1. As explained previously, these signatures are requested from the first analyser 6 of FIG. 1. These signatures are demultiplexed by a de-multiplexer 706 into: audio signatures; audio signature timing data; video signatures; and, video signature timing data.

The video signature from the de-multiplexer 706 will comprise signature data for certain video fields occurring during the 90 field video segment up to and including the requested signature time; typically one byte of motion-based signature data for each of 50 fields, and eight bytes of spatial-based video signature data from each of four fields.

The audio signature from the de-multiplexer 706 will comprise a 120-bit section of audio signature data, selected in the analyser 6 of FIG. 1 according to a maximum entropy criterion.

The video signature timing data, and audio signature timing data from the de-multiplexer 706 enable the timing of the video fields and audio samples from which the respective signature data was determined (in the analyser 6 of FIG. 1) to be identified in terms of the timing data associated with the AV content input (via the channel 2) to the analyser 6 of FIG. 1. This identification will make use of the two-byte timing data within the spatial-based video signature, and the two-byte offset data within the audio signature.

Each requested video signature received from the de-multiplexer 706 is compared, in a video signature comparator 707, with all of the local video signature data from the local video signature generator 703. The comparator 707 finds the local video signature data from the local video generator 703 that best matches the signature from the de-multiplexer 706, and outputs a measure of the similarity of the best-matching local video signature data to the requested video signature. This similarity measure is output as a video similarity output 708.

The video signature comparator 707 also compares:

- the timing data from the de-multiplexer 706 that corresponds to the received video signature With

- the timing data from the de-multiplexer 702 that corresponds to the timing of the best-matching local video signature data.

This timing difference is output as a video timing change output 709.

The video similarity measure can be a measure of confidence in the similarity of the video content captured by the first AV content analyser 6 and by the second AV content analyser 8. In the exemplary embodiment of the invention the video signatures are compared by measuring the absolute difference between the video signatures. In other embodiments of the invention the video signatures may be compared by performing a correlation between the video signatures. As indicated above, in the exemplary embodiment, the video signature is formed from spatial profile data and motion profile data. These components of the video signature may be compared or correlated separately.

Typically several difference or correlation determinations are made at different timing positions within the locally generated signature data from the local video signature generator 703, and the results are evaluated to find the position of best match.

Each received audio signature segment from the de-multiplexer 706 is compared, in an audio signature comparator 710, with all of the local audio signature data from the local audio signature generator 704. The comparator identifies the section of the local audio signature data from the local audio generator 704 that best matches the received audio signature segment and outputs a measure of the similarity of the respective segments as an audio similarity output 711.

The audio signature comparator 710 also compares:

the audio signature timing data from the de-multiplexer 706 that corresponds to the received audio signature segment With:

the timing of the best-matching audio segment as determined by the local timing data from the de-multiplexer 702.

This timing difference is output as an audio timing change output 712.

The audio timing change output 711 can be compared with the video timing change output 709, for example by a subtractor 713, so as to obtain an AV timing change output 714. This output describes the change in audio-to-video relative delay.

Typically the data channel 10 of FIG. 1 will have relatively low bandwidth, and, as can be seen from the above example, only 103 bytes of AV signature data (excluding the definition of the time of analysis) need to be transferred from the analyser 6 to the analyser 8 in order to perform a comparison of their respective AV inputs.

As has been described above, in many current systems there are a plurality of audio channels and the audio signature processes may by applied to only one of, all of, or a sub-set of the plurality of audio channels. In a multi-audio-channel embodiment, audio signature data may be received via the connection 705 for one or more audio channels; and, a plurality of audio channels may be demultiplexed from the data 700 and stored in the memory 701. One or more received audio signatures may be demultiplexed in the de-multiplexer 706 and compared with audio data corresponding to one or more stored audio channels so as to confirm the correspondence of one or more audio channels at the input the analyser 6 of FIG. 1 with one or more of the audio channels in the data 700 input to the analyser 8.

In the exemplary embodiment absolute differences between the received audio signature section and candidate sections of the local audio signature data are determined, and the section with minimum absolute difference is identified as the best match. Note that, as the audio signature data is binary data, the determination of the absolute difference is equivalent to a cross-correlation and can be achieved by a simple exclusive-OR logic operation.

The above techniques thus enable the identification of changes to the audio-visual data that occur between the analysers 6 and 8 of FIG. 1; specifically changes in:

the audio delay relative to the time-code (or nominal position);

the video delay relative to time-code (or nominal position);

the relative delay between any of the audio channels; and, the relative delay between any audio channel and an associated video channel.

Also:

the measure of confidence in the similarity of the video content; and the measure of confidence in the similarity of the audio content can be used, either singly, in combination with each other, or in combination with the above delay measures so as to provide an overall measure of confidence in the similarity of the AV content at the two analysis points.

Figure 8:
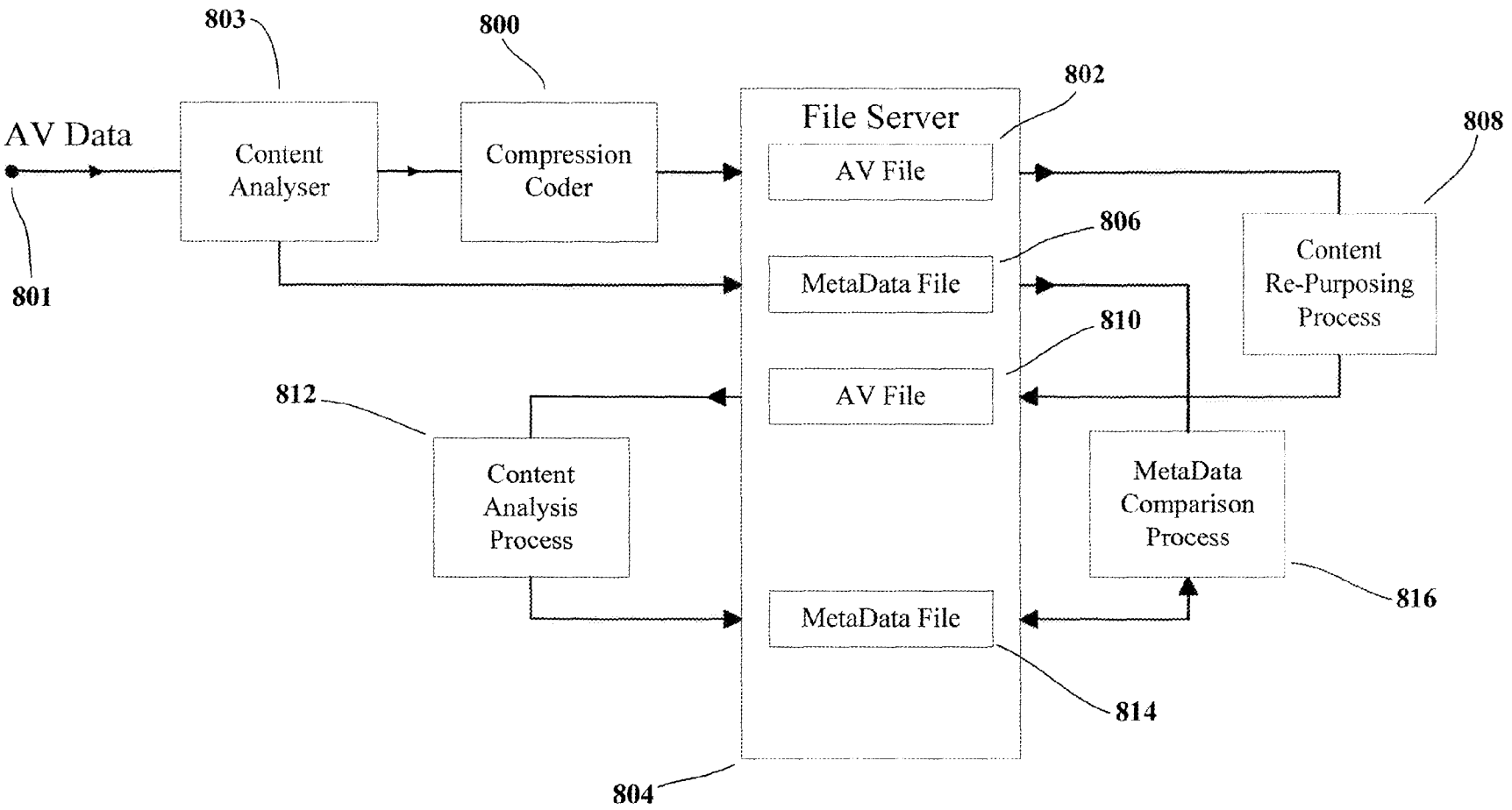
FIG. 8 is a block diagram of a second exemplary embodiment.

A second embodiment of the present invention will now be described with reference to FIG. 8.

Audio-visual data 801 representing AV content is passed through an AV content analyser 803 to a compression encoder 800. The compression encoder generates a first compressed AV file 802 which is stored in memory, for example on a file server 804. The AV content analyser 803 performs an AV content analysis operation as described above in relation to the first embodiment, and stores the resulting audio and video signatures in a first metadata file 806 on the file server 804.

Typically the first compressed AV file 802 may undergo additional processing 808, for example transcoding to a different compression format or other content re-purposing process, to create a second compressed AV file 810.

An AV content analysis process 812 can perform a further AV content analysis of the content of the re-purposed compressed AV file 810. This analysis follows the principles previously described, but also includes full or partial compression decoding of the AV data so as to obtain the necessary audio and video elements for analysis. The result of this content analysis is a second metadata file 814. In this embodiment the AV content analysis 812 is implemented in a software process that operates on the second compressed AV file 810 in accordance with the principles described above to generate the audio signature data and video signatures included in the second metadata file 814, which is stored on the file server 804.

The first metadata file 806 and the second metadata file 804 can be compared in a metadata comparison process 816 operating in accordance with the principles described above. The result of the comparison may conveniently be appended to the second metadata file 814. In an exemplary embodiment the metadata comparison process 816 is implemented as a software process, which could be combined with the content analysis process 812. But as will be apparent to a skilled person, the comparison process 816 may be implemented as a separate software or hardware module.

As described above, an analysis of compressed and uncompressed audio-visual data at different points in an AV system can be made and the results of the analysis can be compared to monitor the AV system. Measures of the respective similarity of the video data and the audio data may be made; timing of respective audio and video signature data relative to time-code, or other timing reference may be evaluated; and/or, the relative delay between the audio data and video data can be detected. The invention therefore provides an advantageous analysis and monitoring system.

The invention may be practiced on streaming video data, but may also be applied to video and audio files. The described signatures may be carried as metadata either directly included in AV communication channels or files, or separately distributed and stored.

The invention may be implemented in hardware or in software as will be apparent to a skilled person.

Although analysis of streaming audio data at 48 kHz has been disclosed herein, it will be known by a person skilled in the art that audio data may be sampled at different sampling rates in different situations. In particular, compressed audio files may typically be sampled at 32 kHz.

Analysis of both audio data and video data together gives more reliable results, but the disclosed methods for the analysis of audio data and video data can be used separately. In particular the comparison of the results of audio and video analysis to give an overall confidence measure based on the similarity of audio and video comparison results may be advantageous in some embodiments.

The reliability of comparisons between signatures may be improved if repeated comparisons are made, and the results of successive comparisons combined recursively, for example in a moving average or other IIR or FIR temporal low-pass filtering process.

Additionally, in some embodiments of the invention other features of the AV data may also be compared. Thus for example, other system parameters that may be compared are: video standard; checksum of a digital program identifier; presence and/or checksum of UMID (Universal multimedia identifier); the presence and/or checksum of any short code label; or the presence of teletext data, subtitles or 'Closed Captions'.

The invention claimed is:

1. A method of comparing audio or audio-visual data in a processor in which a plurality of comparisons are made between first audio signature data derived from two or more audio samples of a first audio or audio-visual sequence and second audio signature data derived at plurality of temporal positions within a second audio or audiovisual sequence and the temporal position of best match of audio signature data is established;

wherein each said audio signature is formed by:

low pass filtering in an infinite impulse response (IIR) filter stage;

high pass filtering in a finite impulse response (FIR) filter stage;

decimating in a decimator; and taking the sign of the output of the decimator.

2. A method according to claim 1 in which the degree of similarity of the audio signature data is used to derive a measure of the similarity of the first and second audio or audio-visual data sequences.

3. A method according to claim 2 in which the temporal position of best match is compared with timing data associated with the first audio signature data so as to derive a measure of audio timing difference between the first and second audio or audio-visual data sequences.

4. A method according to claim 3 in which a measure of video timing difference is compared with the measure of audio timing difference so as to derive a measure of the difference in relative video to audio delay between the first and second audiovisual data sequences.

* * * * *

UNITED STATES PATENT AND TRADEMARK OFFICE

CERTIFICATE OF CORRECTION

PATENT NO. : 8,682,651 B2
APPLICATION NO. : 12/918572
DATED : March 25, 2014
INVENTOR(S) : Jonathan Diggins It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 799 days.

Signed and Sealed this
Twenty-ninth Day of September, 2015

Michelle K. Lee

Michelle K. Lee
*Director of the United States Patent and Trademark Office*